United States Patent [19]

Parks

[11] Patent Number: 4,765,666

[45] Date of Patent: Aug. 23, 1988

[54] ANIMAL WASTE COLLECTOR

[76] Inventor: Jack C. Parks, 4001 Visby La., Las Vegas, Nev. 89119

[21] Appl. No.: 10,185

[22] Filed: Feb. 2, 1987

[51] Int. Cl.[4] ..... A01K 29/00; E01H 1/12

[52] U.S. Cl. ..... 294/1.4; 15/79 A

[58] Field of Search ..... 294/1.3–1.5, 294/19.2, 55; 15/41 R, 49 C, 79 R, 79 A, 82, 83, 104.8, 257.1, 257.3, 257.9, DIG. 1; 56/327 R, 328 R, 400.02, 400.03, 400.11, 400.13; 414/434, 437–443

[56] References Cited

U.S. PATENT DOCUMENTS

| | | | |
|---|---|---|---|
| 425,695 | 4/1890 | Pontious | 56/400.13 |
| 486,066 | 11/1892 | Abrams | 15/104.8 |
| 643,386 | 2/1900 | Smith | 56/400.02 |
| 1,000,912 | 8/1911 | Hooker | 15/79 R |
| 1,224,349 | 5/1917 | Yessne | 15/79 R X |
| 2,782,435 | 2/1957 | Stone | 15/79 A X |
| 2,999,259 | 9/1961 | Polner | 15/104.8 |
| 3,184,775 | 5/1965 | Downey et al. | 15/DIG. 1 |
| 3,308,613 | 3/1967 | Davidson | 56/328 R |
| 4,148,513 | 4/1979 | Gagne | 294/1.4 |
| 4,240,656 | 12/1980 | Eiffinger | 294/1.4 |

*Primary Examiner*—Johnny D. Cherry
*Attorney, Agent, or Firm*—Edward J. Quirk

[57] ABSTRACT

Apparatus for picking up animal waste includes a wheeled cart having a handle and a removable container mounted behind a ramp. A rotatable lever arm lifts articles positioned in front of the cart up the ramp and into the container. The lever arm rotates at a very slow speed (e.g., 10–15 rpm). and is reversible by means of a switch mounted on the handle.

8 Claims, 5 Drawing Sheets

ANIMAL WASTE COLLECTOR

BACKGROUND OF THE INVENTION

This invention relates to a device for collecting small objects, especially dog or other animal feces, lying on the ground or other surface. More specifically, it relates to a portable, compact device with wheels, that can be easily pushed from place to place and operated on demand to sweep up free standing material into a removable container.

It is well known that man's best friend is his dog. However, as our cities continue to grow at an alarming rate, the locations where Rover can be "walked" are reduced. Many dog owners have taken to the streets in an effort to find relief. The problem has become so acute that many cities and private communities have passed legislation or regulations requiring dog owners to pick up and remove dog feces left by their pets.

The present invention provides a method of collecting dog feces or other objects that is simple, clean and efficient. Objects can be collected and stored within the device until a suitable disposal site is found. The present invention provides a light-weight wheeled sweeper that can be pushed by a handle while accompanying a dog on a "walk" or thereafter to collect droppings. Because of its light weight and compact design, the invention is extremely maneuverable and can be pushed practically anywhere. In general, the device consists of a small box-shaped cart with a handle in the rear and two parallel wheels on either side of a collection box. A forwardly extending ramp is located at a bottom center portion of the device, and a rotating wiper is mounted above the ramp to sweep droppings into a rear-mounted container. The wiper is rotated slowly by a 12 v DC electric gearmotor and is activated by a switch located in the handle of the device. The rear mounted container or hopper can be slideably removed for disposal of its contents.

A large number of sweepers and debris collectors have been disclosed in the literature. In general, these devices consist of gear- or belt-driven brushes which rotate at a relatively high speed to sweep up debris in front of the apparatus into a following container. Examples of such devices are Yessne, U.S. Pat. No. 1,224,349, Gomez, U.S. Pat. No. 2,670,485, Olds et al., U.S. Pat. No. 2,244,848, Stone, U.S. Pat. No. 2,782,435, and Adams, U.S. Pat. No. 1,267,304. An unusual apparatus for cleaning sidewalks comprising a motorcycle adapted to pickup dog excrement on sidewalks having a rotatable brush coupled to the transmission of the motorcycle. Generally speaking, the movable cleaners of the prior art are adapted to clean relatively large areas in a rapid, efficient manner.

The apparatus of the invention, however, is adapted to pick up relatively small quantities of waste, such as individual piles of pet excrement. The lift mechanism of the invention is not actuated by the wheels of the device, but rather is selectively actuated by an operator at such time as the cart is positioned adjacent to the object desired to be lifted. Once properly positioned, the lifting mechanism is actuated, moving the object up the ramp and into a removable container. In addition, the lift mechanism of the invention must operate very slowly; the electric motor operates at a speed of less than about 12 RPM to ensure an orderly transfer of the waste from the ground to the cart receptacle. Similarly, the manual lift operation is carried out very slowly at a speed selected by the operator.

BRIEF SUMMARY OF THE INVENTION

An animal waste collection device comprises a cart having a base portion and an upwardly extending handle, a pair of wheels, a ramp extending forwardly and downwardly from the base, and lift means mounted on the base for moving waste from a location in front of the cart up the ramp and into the receptacle. The lift means is actuated either manually or by an electric motor from a switch on the handle. A receptacle which is slideably removable from the base is mounted adjacent the top of the ramp such that materials moving up the ramp drop into the receptacle. The lift means preferably comprises a reciprocating arm having a wiper blade attached thereto which has a travel path along the ramp.

DETAILED DESCRIPTION OF A PREFERRED EMBODIMENT

Figure 1:
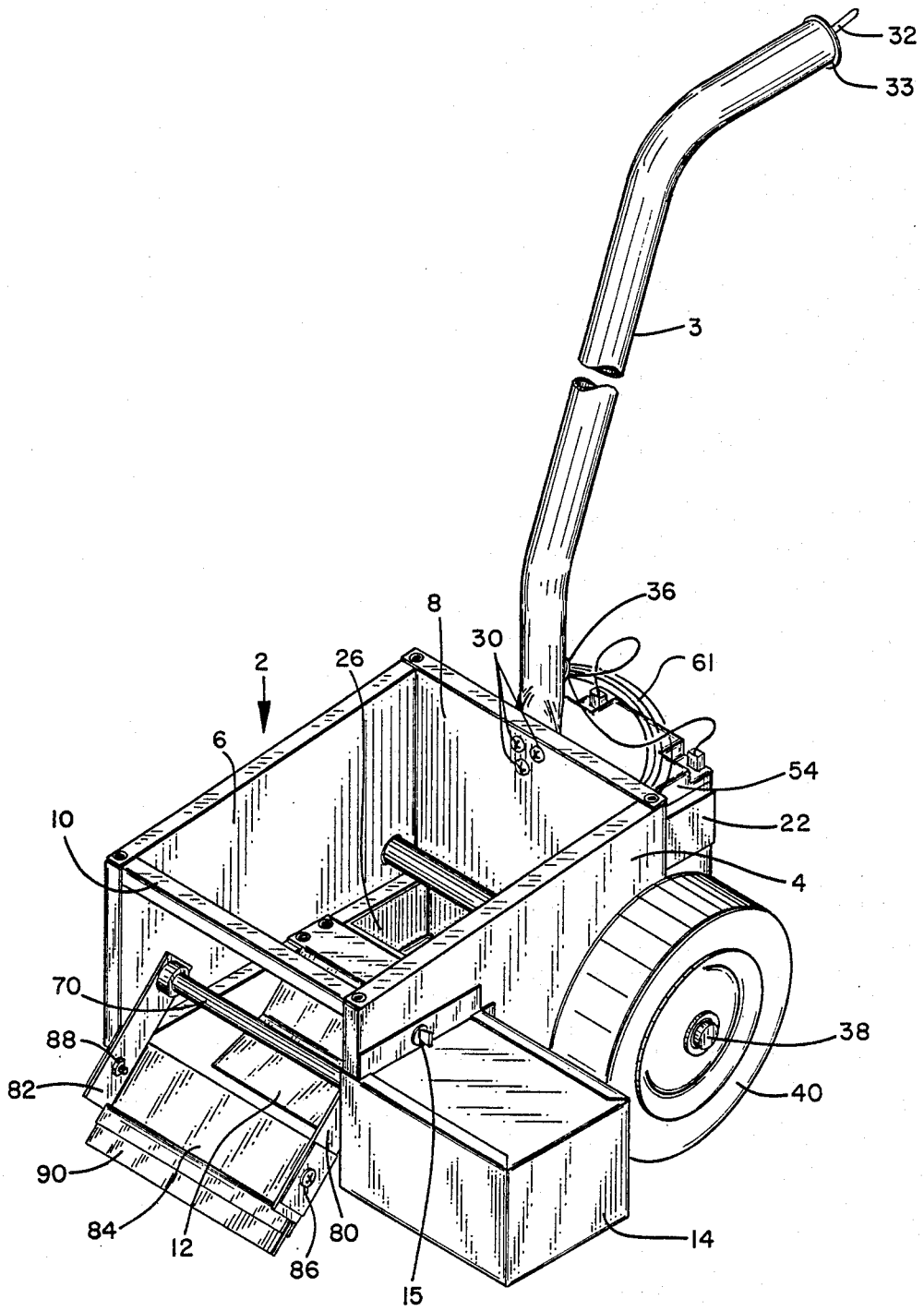
FIG. 1 is a perspective view of the device of the invention with an electrically operated sweeper.

As shown in FIG. 1, the present invention consists generally of cart 2 with tubular, curved handle 3 fastened together by screws 30. Wheels 40 and 42 (see FIG. 2) are mounted on axle 38 and are arranged in a parallel configuration on either side of cart 2. Sweeper lift 84 has a flexible rubber wiper pad or "squeegee" 90 fixed rigidly parallel to shaft 70. DC gearmotor 60 (see FIG. 2) is connected to shaft 70 and is housed under removable cover 14. DC gearmotor 60 is powered by rear-mounted battery 54 and is activated by switch 32 located in the end of handle 3. Ramp 12 is located in a bottom center portion of the cart, adjacent to removable hopper 26.

More specifically, cart 2 is comprised of opposing parallel sides 4 and 6, brace 10, rear wall 8 and ramp 12. Perpendicular flanges or lips extend inwardly at all four edges of side 4 and side 6 as well as on the top and bottom edges of rear wall 8. These flanges are approximately ½" wide. When placed in the configuration as in FIG. 1, flanges of adjacent pieces intersect for fastening together by pop rivets or other fastening means. Cart 4 is roughly box-shaped with a length of approximately 10", a width of approximately 8½" and a height of approximately 5¼" at the front or sweeper end and 6¼" at the rear or battery end.

Motor housing 14 is also fabricated with mounting flanges for attachment to the side wall 4 of the cart. Wing screw 15 is used to secure cover 14 to side 4 at the top and wing screw 17 is used to secure cover 14 to side 4 at the rear (see FIG. 3). Rear wall 8 contains shelf 16 which is fabricated by bending the bottom edge of rear wall 8 90° to the rear (see FIG. 3, FIG. 4 and FIG. 6). Shelf 16 is approximately 6" wide and 3" long and is used to support battery 54. Gussets 18 and 20 are located between rear wall 8 and shelf 16 and provide additional support (as tension members) to shelf 16 (see FIGS. 3 and 4). Gusset 18 is fastened to shelf 16 by screw 19 and gusset 20 is fastened to shelf 16 by screw 21 (see FIG. 4). Battery 54 is mounted on shelf 16 and held in place by strap 22. Battery 54 is a commercially available unit commonly used on motorcycles such as a Challenger M32A5B supplying 12 v. DC and having a positive and negative terminal. A 6 v. lantern battery may be used, and the lift will turn more slowly. A metal strap 22, shown in FIGS. 1 and 3, retains the battery on the shelf.

In an alternate embodiment useful for collecting horse manure, the motor may be driven by a 12 v. DC battery or a 110 v. AC source. In either case, the speed of rotation is kept to less about 12 rpm. The horse manure collector is somewhat larger in overall size than the embodiment used to collect dog waste.

Figure 4:
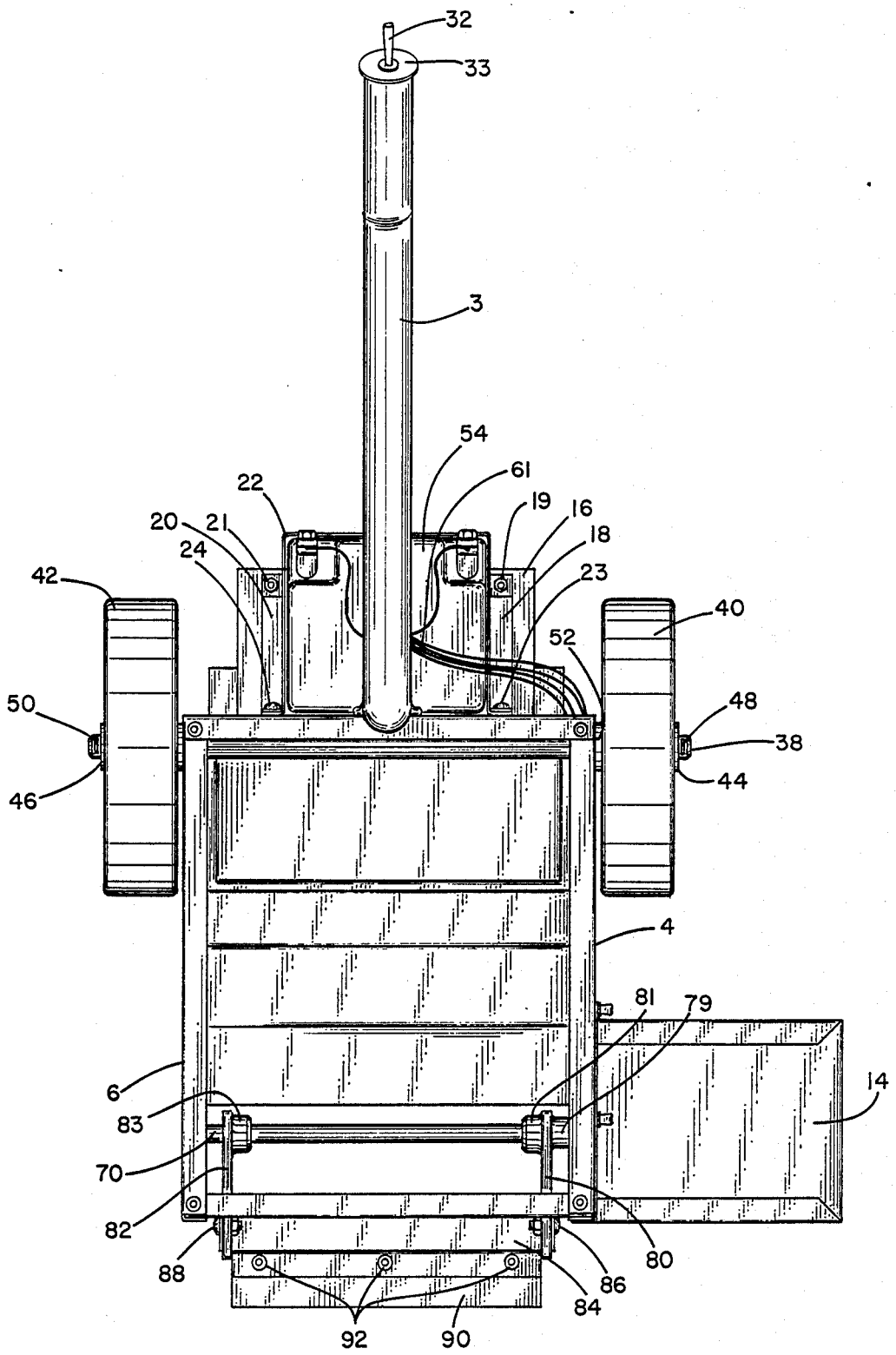
FIG. 4 is a plane view of the electric unit.

As shown in FIG. 4, screw 23 fastens both the top of gusset 18 and one end of strap 22 to rear wall 8 and screw 24 fastens the other end of strap 22 and gusset 20 to rear wall 8.

Figure 6:
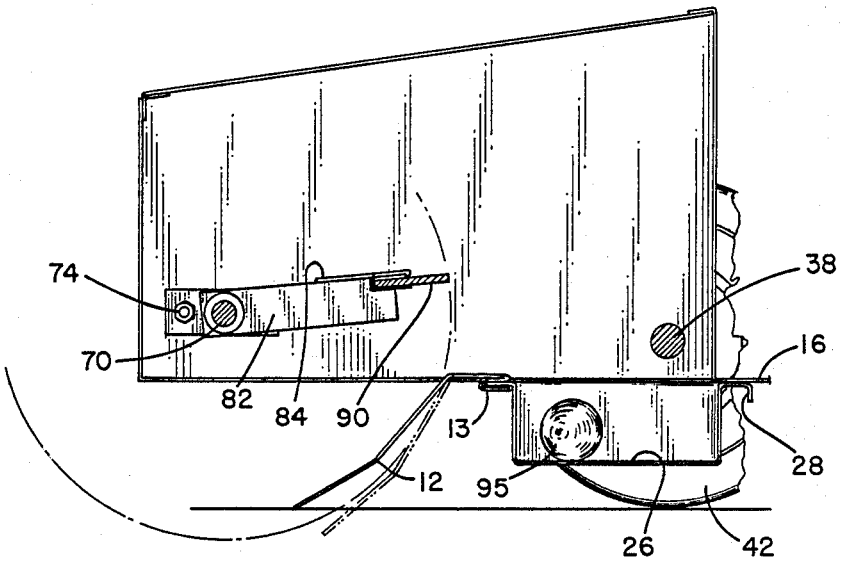
Figure 7:
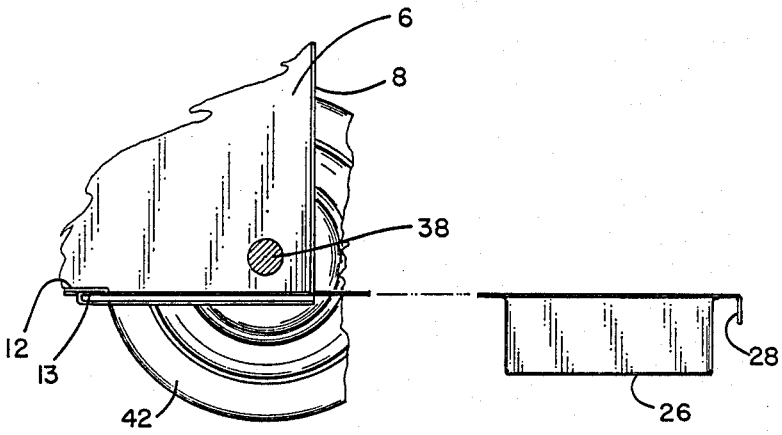
FIG. 7 is a cross-sectional view showing the hopper removed.

Hopper or receptacle 26, shown in FIG. 1, is located at the rear bottom of the cart and extends the full width of cart 2. The hopper is removable by pulling on hopper handle 28 and sliding it out rearwardly as seen in FIG. 7. Hopper 26 is held in place by S-bends located on both sides and the front of hopper 26. Front S-bend 13 is formed by bending the rear edge of ramp 12, as shown in FIG. 6 and FIG. 7, and then locating ramp 12 into cart 2 and riveting it into place (see also FIG. 1). The S-bends on either side of the hopper 26 are formed by bending the bottom rear edges of side 4 and side 6. The side S-bends extend forwardly from rear wall 8 about $3\frac{1}{2}''$ where they abut the S-bend in ramp 12 (see FIG. 7). When the three S-bends are in assembled configuration they form a U-shaped channel that holds the front and two sides of hopper 26 in place.

Tubular handle 3 is located at the rear of the cart and extends upwardly and rearwardly in smooth bends as shown in FIG. 1. Switch 32 is mounted in plug 33 and secured in place with a washer and nut (not shown). The switch is biased to a neutral (off) position; lifting the switch upwardly causes forward rotation of the lift, and pushing downwardly rotates the lift in a backwards direction. Alternatively, a normally open push-button switch may be used; the switch must be pushed and held in to keep the motor running. Plug 33 is press fit into the end of handle 3. Wires 61 from switch 32 run down the inside hollow center of handle 3 and out a hole in which is mounted rubber grommet 36 (see FIG. 1). Wires 61 then connect to battery 54 and to reversible DC gearmotor 60 under housing 14.

In the assembled configuration the surface end of handle 3 is approximately 33 inches above the ground surface and extends rearwardly approximately 14 inches from rear wall 8. In addition, the switch end of handle 3 makes an angle of approximately 60° to a line normal to the ground surface. The shape of handle 3 and location are important for the comfort of the operator and can be varied to accommodate any special operator characteristics. The mounting end of handle 3 is flattened (see FIG. 2 and FIG. 3) where it is fastened to rear wall 8 by screws 30. The flattened surface provides a greater bearing surface between handle 3 and rear wall 8 and thereby increases the rigidity and strength of the handle/rear wall connection.

Axle 38 extends through left side 4 and right side 6 of cart 2 and protrudes beyond the ends of wheels 40 and 42 as shown in FIG. 4. Flat washers 44 and 46 and cotter pins 48 and 50 are utilized to retain wheels 40 and 42 on axle 38 (see FIG. 3 and FIG. 4). Wheels 40 and 42 of the preferred embodiment have self-contained bearings or bushings; therefore, axle 38 can be either fixed in housing 2 or free-floating. The wheel material can be steel or plastic with a rubber tread around its circumference. The approximate dimensions are $5\frac{1}{2}'' \times 1''$. Wheels with these features are commonly found on lawn mowers and small carts and are usually slightly wider in the centers than at their circumference. Therefore, they can be abutted against a flat surface, as in the invention, without their rotating tread rubbing against the flat surface. If wheels of other dimensions are contemplated, a spacer 52, as shown in FIG. 4, may have to be used to prevent the wheel from rubbing against side 4.

Figure 2:
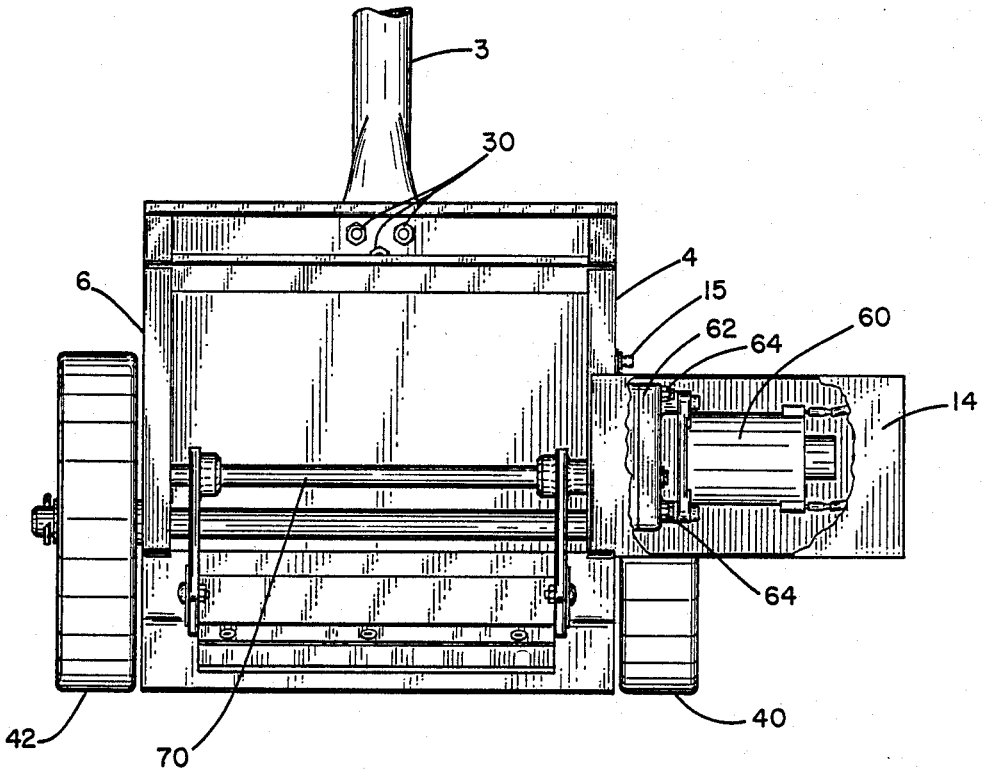
FIG. 2 is a front elevational view with a cutaway of the DC gearmotor unit.
Figure 3:
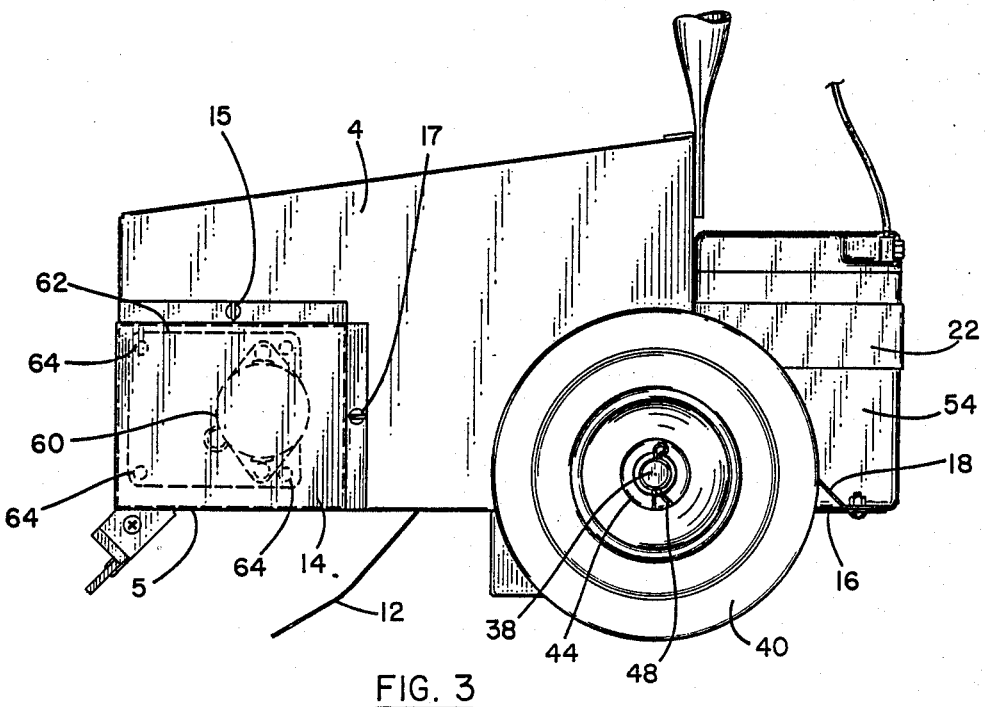
FIG. 3 is a side elevational view of an electrically operated unit.

The lift or sweeper mechanism is located at the front of cart 2 and is operated by electric DC gearmotor 60 located inside of cover 14 (see FIG. 2 and FIG. 3). DC gearmotor is a commercially available unit such as a Dayton model 4Z835 with a reduction ratio of 580:1 and operating on 12 volts DC. The motor is designed to be reversible and to operate at less than 20 rpm, preferably from 6 to 15 rpm. A 3 amp drive fuse (not shown) may be used to protect the motor if the lift becomes jammed.

Referring to FIG. 4, drive shaft 70 extends between right side 6 and left side 4 and connects to DC gearmotor 60. As shown in FIGS. 2 and 3, DC gearmotor 60 is attached to cart side 4 by screws 64 at each corner of its square mounting flange 62. Thus, motor 60 supports shaft 70 on side 4. Shaft 70 is supported by block 72 which is secured to side 6 by screws 74 and 76 (see FIG. 5). Block 72 is a steel strip, rectangular in shape and approximately $\frac{1}{8}''$ thick. A hole (not shown) is formed in its center and has a diameter larger than the diameter of shaft 70.

Arm 80, circular flange 79 and circular flange 81 are welded together in the configuration shown in FIG. 4. Arm 82 is also welded to circular flange 83. All 3 flanges 79, 81, and 83 contain allen head set screws (not shown) extending radially from the axis of shaft 70. The set screws are tightened down until they bear against "flats" machined into the surface of shaft 70, thereby locking the arm/flange assembly onto shaft 70. Shaft 70 and the two arm/flange assemblies operate as a solid, integral unit. Lift 84 is rectangular in shape with its ends bent at 90° to its surface. The ends are fixed to the outsides of arms 80 and 82 by screws 86 and 88 (see FIG. 1). The bottom edge of lift 84 contains an S-shaped bend shown in FIGS. 5 and 6. Rubber wiper pad 90 is inserted into the S-bend (see FIGS. 5 and 6) and held in place by pop rivets 92 (see FIG. 4).

Figure 5:
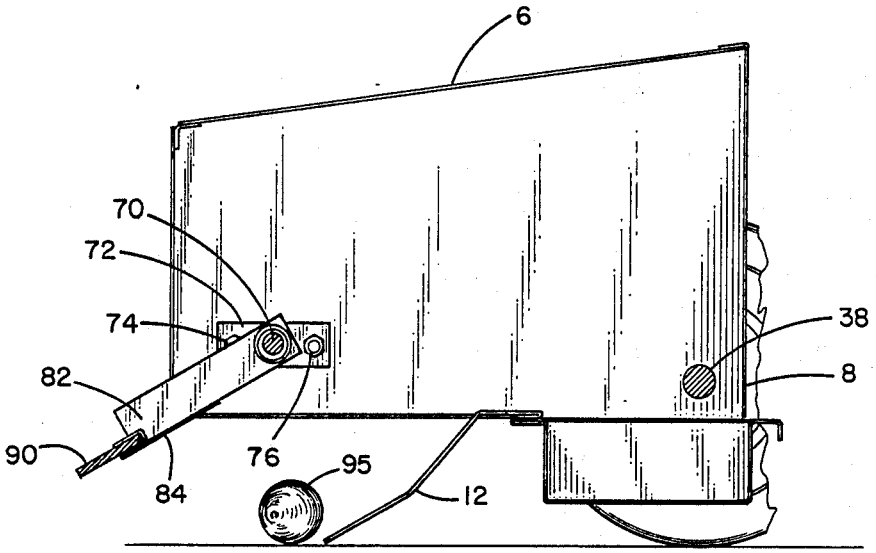
FIGS. 5 and 6 are cross-sectional views showing the sweeper door ramp and hopper in operation.

An important feature of the invention is the vertical relationship or placement of axle 38, shaft 70 and ramp 12. Referring to FIG. 5 and FIG. 6, the vertical placement of axle 38 must be such that when sweeper lift 84 is rotated by shaft 70, lift means comprising flexible rubber wiper blade 90 must just contact or slightly interfere with the ground surface. In this manner, rubber pad 90 will sweep all matter up ramp 12 and into hopper 26. If rubber pad 90 contacts the ground too sharply, it cannot complete its sweeping rotation. If rubber pad 90 is too high, material will escape under the rubber pad and not be swept up. Therefore, the vertical placement of shaft 70 and axle 38 must be such that when cart bottom surface 5 is substantially parallel to the ground surface, the circumference of wheel 42 is firmly situated on the ground and rubber pad 90 just contacts or slightly interferes with the ground surface. In addition, the end of ramp 12 must be in contact with the ground surface. As best seen in FIG. 6, the ramp is slightly resilient, and can flex when pressure is applied downwardly to the front of the cart, thus maintaining a more shallow angle to the cart. The normal resting position of the ramp is shown in phantom in FIG. 6, with an operating position shown in FIGS. 5 and 6.

All parts of cart 2 including side 4, side 6, rear wall 8, which includes shelf 16, brace 10, ramp 12, cover 14, gussets 18 and 20, strap 22, hopper 26, which includes handle 28 and lift 84 are constructed from galvanized steel. The rear wall, ramp, gussets, and strap are 22 gauge; the remaining parts are 26 gauge. Where assembly is permanent, aluminum pop rivets are used but where parts must necessarily be removed for inspection or replacement, such as cover 14, strap 22 and lift 84, screws with nuts are utilized as shown in the drawings. However, sheet metal screws or other fastening means can be utilized as required. Axle 38, sweeper lift arms 80 and 82, flanges 79, 81 and 83, shaft 70 and block 72 are constructed from mild steel such as SAE 1010 or SAE 1020 and can be galvanized, painted or otherwise protected from corrosion. Other structural plastic or aluminum materials may be used.

Handle 3 is constructed of aluminum with an outside diameter of 1" and a wall thickness of 0.048".

In action, the operator first grips the cart near the switch end of handle 3 and pushes the handle downwardly to raise lift 84 off the ground. This allows the cart to be wheeled about from place to place. When it is desired to pick up pet droppings, the cart is aligned so that the matter is positioned midway between sides 4 and 6 and as close as possible to ramp 12. Ramp 12 is lowered to the ground by raising handle 3. This raising motion on handle 3 lowers ramp 12 since wheels 40 and 42 act as fulcrums. Once properly positioned, switch 32 is activated, causing battery 54 to operate DC gearmotor 60. DC gearmotor 60 then rotates shaft 70 with integrally attached arms 80 and 82. The arms 80 and 82 propel sweeper lift 84 with attached rubber wiper blade 90 in a circular, counterclockwise direction, contacting matter 95 and causing it to move up and over ramp 12 and into hopper 26. When repeated sweeps cause hopper 26 to become full, or after any use, the hopper can be removed by sliding it out rearwardly and the contents discarded.

Lift 84 can also be activated by manual means. In this version battery 54, switch 32, wires 61, DC gearmotor 60, shelf 16, gussets 18 and 20, strap 22 and block 72 are unnecessary.

Figure 8:
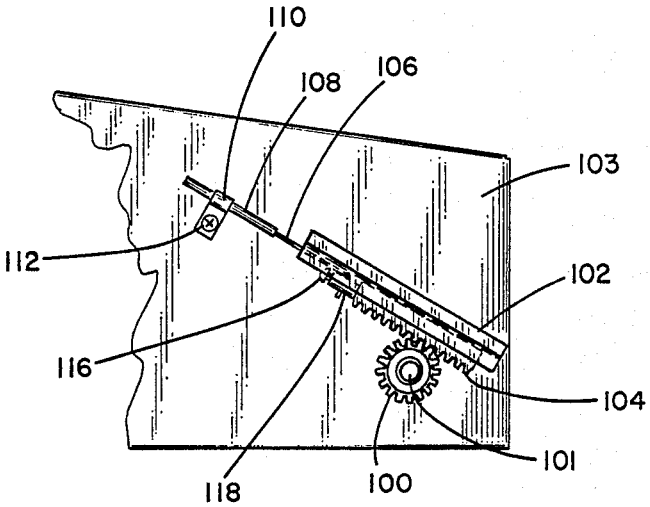
FIG. 8 is a side view of the rack and gear mechanism of a manually operated unit.

In the manual version shown in FIG. 8, the wiper blade is actuated by a rack and pinion gear mechanism from remote actuating cable. Gear 100, with allen head set screw located radially from the axis of the gear bore, is mounted on shaft 101 on the side panel 103. Rack 104 meshes with gear 100 and is held in place by guide 102 which is spot welded to side panel 103. Rack 104 is free to slide backward and forward along the length of guide 102. Remote actuator cable 106 sliding in sheath 108 is attached at one end to rack 104 by clamp 118 and screw 116. The other end of wire 106 is attached to a lever (not shown) and held in a fixed position near the end of the cart handle by a strap and clamp. Outer sheath 108 is mounted to side 103 by clamp 110 and screw 112. By a push/pull action on the lever, wire 106 causes rack 104 to slide backward and forward in guide 102. The movement of rack 104 causes a force to be applied to gear 100 and a subsequent torque to be transmitted to shaft 101. Lift 84 can then be rotated about the axis of shaft 101 as in the electric DC gearmotor version through about 180° of circumference, reciprocating back and forth between a forwardly extending horizontal position and a rearwardly extending horizontal position. Movement of the lever thus actuates the wiper blade to pick up the refuse.

The invention has been described with respect to several preferred embodiments thereof. However, numerous modifications and addendums to the invention can be made and will be obvious to those skilled in the art. Therefor, the invention should not be considered limited by the foregoing disclosure but rather should be defined only by the following claims.

I claim:

1. Animal excrement collection apparatus comprising a cart having a base and a handle extending upwardly from the base, wheel means attached to the base for transporting the cart, a receptacle removably mounted on the base, ramp means extending downwardly and forwardly from the base and positioned such that objects moving upwardly on the ramp means drop into the receptacle, lift means including a rigid arm mounted on the base transverse to the ramp means and adapted to traverse the ramp means for moving animal excrement from a location in front of the cart up the ramp means and into the receptacle, and actuating means independent of the wheel means for moving the lift means along the ramp means, said actuating means comprising a DC motor operatively connected to the lift means, a battery mounted on the base electrically connected to the DC motor, and switch means for activating the motor.

2. The apparatus of claim 1 wherein the lift means also comprises flexible wiper means mounted on the arm and adapted to slideably engage an upper surface of the ramp means.

3. The apparatus of claim 1 wherein the ramp means comprises a slightly flexible metal scoop.

4. The apparatus of claim 1 wherein the lift means comprises an arm rotatable about an axis parallel to the ramp means, said axis being mounted on the base forwardly from and above the ramp means, said arm movable along an arc at least partly coincident with an upper surface of the ramp means.

5. The apparatus of claim 4 wherein the upper surface of the ramp means has a slightly concave cross-sectional curvature.

6. The apparatus of claim 1 wherein the ramp means has an upper end portion attached to the base, and a lower end portion adapted to engage the ground.

7. The apparatus of claim 1 wherein the actuating means comprises a reversible DC motor which is operably connected to drive the lift means at a speed of rotation not greater than 20 rpm, and switch means mounted on an end portion of the handle for activating the DC motor.

8. The apparatus of claim 1 wherein the DC motor is operably connected to drive the lift means at a speed of rotation of from about 6 to about 15 rpm.

* * * * *